United States Patent [19]

Bower et al.

[11] 4,226,558

[45] Oct. 7, 1980

[54] CONTROL SYSTEM

[75] Inventors: Lewis R. B. Bower; Philip W. Dudley; John C. Smith, all of Wakefield, England

[73] Assignee: Fletcher Sutcliffe Wild Limited, Wakefield, England

[21] Appl. No.: 12,853

[22] Filed: Feb. 16, 1979

[51] Int. Cl.[3] ..... E21D 23/12

[52] U.S. Cl. ..... 405/302; 137/109; 137/115

[58] Field of Search ..... 405/291-302; 299/31; 91/170 MP; 137/109, 111, 114

[56] References Cited

U.S. PATENT DOCUMENTS

| | | | |
|---|---|---|---|
| 3,168,010 | 2/1965 | Thomas | 137/114 X |
| 3,359,043 | 12/1967 | Papin | 137/109 X |
| 3,410,295 | 11/1968 | Malott | 137/114 |
| 3,866,623 | 2/1975 | Klimek | 137/111 X |

FOREIGN PATENT DOCUMENTS

| | | | |
|---|---|---|---|
| 1183042 | 12/1964 | Fed. Rep. of Germany | 405/302 |
| 1082257 | 9/1967 | United Kingdom | 405/302 |
| 265824 | 1/1971 | U.S.S.R. | 405/302 |

*Primary Examiner*—Dennis L. Taylor

*Attorney, Agent, or Firm*—Trexler, Wolters, Bushnell & Fosse, Ltd.

[57] ABSTRACT

A control system for a hydraulically powered self advancing mine roof support, which system ensures that a hydraulically extensible chock leg of the support is set to a predetermined pressure, irrespective of the length of time that a main inlet valve is held open comprises an auxiliary valve interposed between a main valve and a chock leg(s) in a fluid supply line extending from a high pressure line to the support, a bypass line connected to the high pressure line in advance of the main valve and extending to the auxiliary valve, the auxiliary valve being so constructed as to open upon sensing a predetermined pressure and to close upon sensing a higher predetermined pressure.

5 Claims, 3 Drawing Figures

CONTROL SYSTEM

This invention relates to a control system for a hydraulically powered, self-advancing mine roof support.

Such supports are employed for instance in longwall coal mining operations and incorporate a plurality of hydraulically extensible chock legs extending between a floor-engaging base member(s) and a roof-engageable roof beam(s), at least one advancing ram extending from the support to a pan of an armoured conveyor extending along the coal face. The support may also include hydraulic rams to actuate forepoling beams or for other purposes. All these hydraulic devices are operated from a bank of valves and a common system is for the "adjacent control" technique to be employed whereby the support operator, under the protection of a support set in its roof supporting condition, operates a bank of valves in that support firstly to lower an adjacent support from the roof, with either full or partial disengagement of the roof beam(s) from the roof, secondly to advance that support to the previously-advanced conveyor, and thereafter to re-set the support in its roof engaging condition by admitting pressure fluid to the chock leg(s) to extend the latter. However, correct setting of the chock legs is governed firstly by the required setting pressure being available from the hydraulic mains supply line and secondly by the operator holding the relevant valve open a sufficient length of time to allow the pressure to stabilise between the mains supply and the chock leg(s).

The present invention is aimed at providing a mine roof support control system whereby the setting pressure in a leg is positively ensured once the relevant valve has been actuated by the operator, irrespective of how long that valve is held open.

According to the present invention, a mine roof support control system comprises an auxiliary valve interposed between a main valve and a chock leg(s) in a fluid supply line extending from a high pressure line to the support, a bypass line connected to the high pressure line in advance of the main valve and extending to the auxiliary valve, the auxiliary valve being so constructed as to open upon sensing a predetermined pressure and to close upon sensing a higher predetermined pressure.

Thus, once the main valve is actuated by the operator to supply fluid to the chock leg(s) to effect extension thereof to set the support to the roof, this higher pressure is sensed by the auxiliary valve which then moves to an open condition whereby pressure fluid is able to bypass the main valve and to pass from the high pressure line through the auxiliary valve and thereafter to the chock leg(s), irrespective of the length of time that the main valve is held open, the auxiliary valve subsequently sensing the attainment of the higher predetermined pressure whereupon it moves into a closed condition to shut off the bypass line.

In principle, the auxiliary valve's bypass line can be connected either to a conventional mains pressure line if the latter is able to supply hydraulic fluid at the required leg setting pressure or to an auxiliary pressure line containing fluid at the required leg setting pressure.

In detail, the auxiliary valve may comprise a main port extending through the valve body, first and second ports intersecting the main port and each first and second port housing a spring loaded hydraulically balanced poppet valve member, the first port being intersected by an auxiliary inlet port connectable to a bypass line, the intersection being at a neck between the valve member and a head carried by the neck, the head being subjectable to fluid pressure within the main port and being displaceable from the main port to unseat the valve member upon fluid loading on the head being greater than the spring loading in the opposite direction, a transfer port communicating the first port downstream of the valve member thereof to the second port, the poppet valve in the second port opening upon fluid passing through the first port to the second port via the transfer port, and thereby into the main port, and the second poppet valve being closable under the influence of its spring upon fluid pressure in the main port equalling fluid pressure in the second port, the transfer port, and the first port.

In operation the auxiliary valve does not interfere with any of the main valve functions, but ensures that when the chock leg(s) has been set for instance in excess of 55 bar (800 psi f) the auxiliary valve opens allowing the higher pressure to automatically raise the leg pressure to the pressure existing in the high pressure line whether this be a mains line or an auxiliary boost pressure line.

The auxiliary valve is therefore fully automatic, and can be manufactured of small size and hence relatively inexpensively. It can be mounted in single or any multiple bank unit to suit the hydraulic circuit or mounting facilities. The body of the auxiliary valve may be made from brass and the poppets from stainless steel. A shut-off valve may be provided to lock out the auxiliary valve should the need ever arise.

The invention will now be further described by way of examples, with reference to the accompanying drawings in which FIG. 1 is a first embodiment of schematic circuit of the mine roof support control system in accordance with the present invention;

In all Figures like reference numerals are employed for like components.

Figure 1:
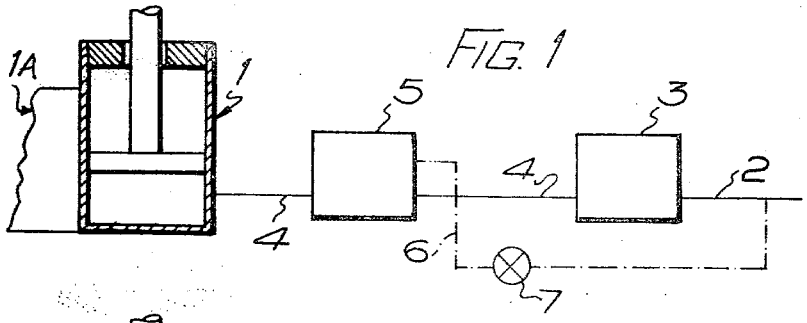

In the circuit of FIG. 1, the mine roof support control system can be seen to comprise a hydraulically extensible chock leg 1 of a hydraulically powered, self-advancing mine roof support shown at 1A a high pressure line 2, a main valve 3, a fluid supply line 4 extending between the main valve 3 and the chock leg 1, the supply line 4 incorporating an auxiliary valve 5, while a by-pass line 6 connects the auxiliary valve 5 to the high pressure line 2 at a location upstream of the main valve 3, the by-pass line 6 incorporating a shut-off valve 7.

Figure 2:
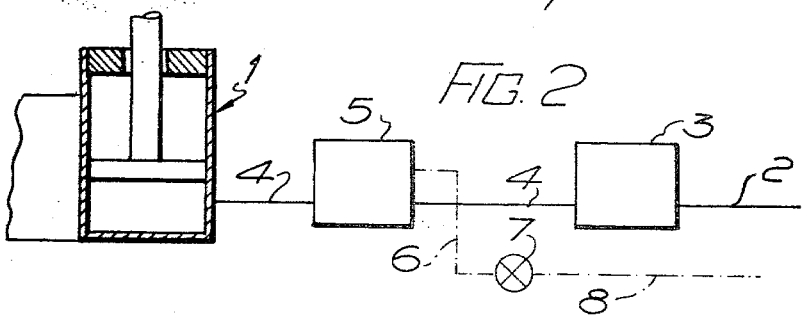
FIG. 2 shows a second embodiment of such a circuit.

In the circuit of FIG. 2, a boost pressure line 8 is provided and the by-pass line 6 connects the auxiliary valve 5 to the boost pressure line 8. Otherwise the circuit is as described with respect to FIG. 1.

Figure 3:
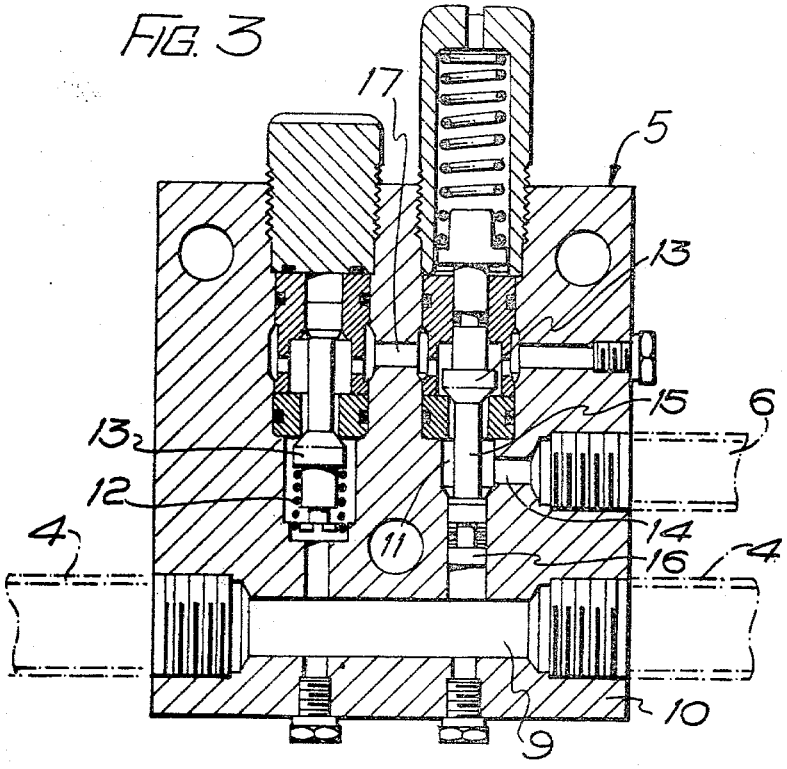
FIG. 3 shows a suitable auxiliary valve.

For the circuit of both FIGS. 1 and 2, the auxiliary valve is as shown in FIG. 3, and comprises a main port 9 extending through the valve body 10, first and second ports 11 and 12 respectively intersecting the main port 9 and each first and second port 11, 12 housing a spring loaded hydraulically balanced poppet valve member 13, the first port 11 being intersected by an auxiliary inlet port 14 connectable to the bypass line 6, the intersection being at a neck 15 between the valve member 13 and a head 16 carried by the neck, the head being subjectable to fluid pressure within the main port 9 and being displaceable from the main port 9 to unseat the valve member 13 upon fluid loading on the head 16 being greater than the spring loading in the opposite direction. A transfer port 17 communicates the first port 11 downstream of its valve member 13 to the second port 12, the poppet valve 13 in the second port opening upon fluid passing through the first port 11 to the second port 12 via the transfer port 17, and thereby into the main port 9, and the second poppet valve 13 being closable under the influence of its spring upon fluid pressure in the main port 9 equalling fluid pressure in the second port 12, the transfer port 17, and the first port 11.

In use, to extend the chock leg 1, the operator moves a control handle (not shown) on the main valve 3 to connect the high pressure line 2 to the supply line 4. The resulting increase in pressure in the main port 9 of the auxiliary valve 5 acts both on valve member 13 of port 12 to urge that valve member into tighter seating engagement and on head 16 to displace the latter away from the main port 9 and hence unseat the valve member 13 of port 11. This puts the auxiliary inlet port 14 into communication with transfer port 17, the auxiliary communication port 14 being connected to the by-pass line 6, so that with the circuit of FIG. 1 the fluid in high pressure line 2 is in communication with the transfer port 17 or with the circuit of FIG. 2, the boost pressure line 8 is in communication with the transfer port 17. Such pressure in the transfer port 17 unseats the valve member 13 in the port 12 thereby transferring fluid from the transfer port 17 into the main port 9 and hence via the supply line 4 to the chock leg 1. This flow of fluid continues until fluid pressure in the main port 9, the first and second ports 11 and 12 and the transfer port 17 are equal, whereupon the valve member 13 in the second port 12 closes under the influence of its spring loading and the operating cycle is complete.

What we claim is:

1. A mine roof support control system comprising at least one hydraulically powered, self-advancing mine roof support, at least one hydraulically extensible chock leg forming part of said mine roof support, a high pressure fluid line, a fluid supply line extending from said high pressure line to said support, a main valve, an auxiliary valve interposed between said main valve and said chock leg(s), a bypass line connected to said high pressure line in advance of said main valve and extending to said auxiliary valve, said auxiliary valve being so constructed as to open upon sensing a predetermined pressure and to close upon sensing a higher predetermined pressure.

2. A system as claimed in claim 1, wherein said bypass line of said auxiliary valve is connected to a conventional mains fluid pressure line.

3. A system as claimed in claim 1, wherein said bypass line of said auxiliary valve is connected to an auxiliary pressure line containing fluid at a setting pressure required for said chock leg.

4. A system as claimed in claim 1, wherein said auxiliary valve comprises a valve body, a main port extending through said valve body, first and second ports intersecting said main port, a spring loaded hydraulically balanced poppet valve member housed in each of said first and second ports, an auxiliary inlet port intersecting said first port, a bypass line connected to said auxiliary inlet port, a neck carried by said valve member of said first port at a location upstream of said valve member, said intersection occurring at said neck, a head carried by said neck beyond said auxiliary inlet port, said head being subjectable to fluid pressure within said main port and being displaceable from said main port to unseat said valve member of said first port upon fluid loading on said head being greater than said spring loading in the opposite direction, a transfer port communicating said first port downstream of said valve member thereof to said second port, said poppet valve in said second port opening upon fluid passing through said first port to said second port via said transfer port, and thereby into said main port, and said second poppet valve being closable under the influence of said spring pressure upon fluid pressure in said main port equalling fluid pressure in said second port, said transfer port, and said first port.

5. A system as claimed in claim 1, comprising a shut-off valve capable of locking out said auxiliary valve.

* * * * *